US007847795B2

(12) United States Patent
Rodriguez et al.

(10) Patent No.: US 7,847,795 B2
(45) Date of Patent: Dec. 7, 2010

(54) METHOD AND SYSTEM FOR CONTROLLING SPATIAL LIGHT MODULATOR INTERFACE BUSES

(75) Inventors: Hector C. Rodriguez, Richardson, TX (US); James N. Hall, Parker, TX (US)

(73) Assignee: Texas Instruments Incorporated, Dallas, TX (US)

( * ) Notice: Subject to any disclaimer, the term of this patent is extended or adjusted under 35 U.S.C. 154(b) by 758 days.

(21) Appl. No.: 11/754,176

(22) Filed: May 25, 2007

(65) Prior Publication Data

US 2008/0291185 A1 Nov. 27, 2008

(51) Int. Cl.
*G09G 3/00* (2006.01)

(52) U.S. Cl. ..... 345/205; 345/32; 348/758; 348/759; 398/44; 359/291; 710/305

(58) Field of Classification Search ..... 345/32, 345/205, 87, 100, 691; 348/758, 759; 359/224.2, 359/237, 259, 291, 325; 349/139, 152; 385/14, 385/15; 710/305; 398/43, 44
See application file for complete search history.

(56) References Cited

U.S. PATENT DOCUMENTS

| | | | | |
|---|---|---|---|---|
| 4,747,069 | A * | 5/1988 | Grinberg et al. | 708/801 |
| 6,232,936 | B1 * | 5/2001 | Gove et al. | 345/85 |
| 7,095,547 | B2 | 8/2006 | Aubuchon et al. | 359/291 |
| 7,657,041 | B1 * | 2/2010 | Ko | 381/120 |

* cited by examiner

*Primary Examiner*—Abbas I Abdulselam
(74) *Attorney, Agent, or Firm*—Charles A. Brill; Wade James Brady, III; Frederick J. Telecky, Jr.

(57) ABSTRACT

In accordance with the teachings of the present disclosure, a method and system for controlling spatial light modulator buses are provided. In accordance with one embodiment of the present disclosure, a bus controller includes a configurable bus interface having first and second modes of operation. The first mode of operation is configured to interface with a single spatial light modulator. The second mode of operation is configured to interface in parallel with a plurality of spatial light modulators. In accordance with another embodiment of the present disclosure, a method of controlling a bus includes configuring a bus interface of a bus controller to interface in parallel with a plurality of digital micromirror devices.

20 Claims, 2 Drawing Sheets

METHOD AND SYSTEM FOR CONTROLLING SPATIAL LIGHT MODULATOR INTERFACE BUSES

TECHNICAL FIELD OF THE DISCLOSURE

This invention relates in general to bus controllers, and more particularly to a method and system for controlling spatial light modulator interface buses.

BACKGROUND OF THE DISCLOSURE

Some light modulators spatially modulate light in response to signals received from a bus. The signals typically have a particular format corresponding to the light modulator. In some applications, signal integrity is critical to performance.

SUMMARY OF THE DISCLOSURE

In accordance with one embodiment of the present disclosure, a bus controller includes a configurable bus interface having first and second modes of operation. The first mode of operation is configured to interface with only one spatial light modulator. The second mode of operation is configured to interface in parallel with a plurality of spatial light modulators In accordance with another embodiment of the present disclosure, a method of controlling a bus includes configuring a bus interface of a bus controller to interface in parallel with a plurality of digital micromirror devices.

Technical advantages of some embodiments of the present disclosure include a configurable bus controller operable to interface with one or more spatial light modulators in various modes of operation. Some embodiments may enhance signal communication integrity between a bus controller and one or more light modulators. Various embodiments may use a single bus controller to interface with multiple light modulators, thereby enhancing cost-efficiency.

Other technical advantages of the present disclosure will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the present disclosure and its advantages, reference is now made to the following description, taken in conjunction with the accompanying drawings, in which.

DETAILED DESCRIPTION OF THE DISCLOSURE

In accordance with the teachings of the present disclosure, a method and system for controlling spatial light modulator buses are provided. The method and system may be used in any of a variety of spatial light modulators, including, for example, deformable micromirror devices. An example of one such deformable micromirror device is a digital micromirror device (DMD™) made by Texas Instruments Inc. Particular examples specified throughout this document are intended for example purposes only, and are not intended to limit the scope of the present disclosure. In particular, this document is not intended to be limited to a particular spatial light modulator, such as, a DMD™. Moreover, the illustrations in the FIGURES are not necessarily drawn to scale.

Figure 1:
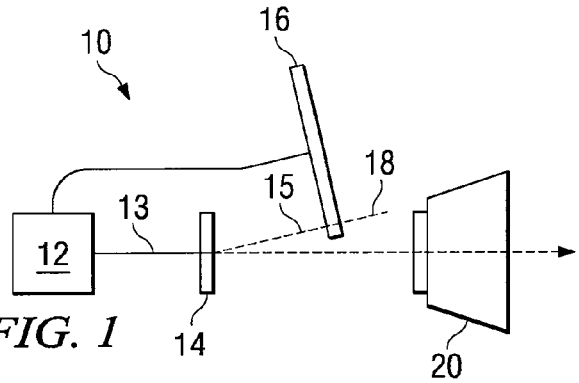
FIG. 1 is a block diagram of a portion of an optical system having a controller communicatively coupled to a light modulator in a first mode of operation according to one embodiment of the present disclosure.

FIG. 1 is a block diagram of a portion of an optical system 10 having a controller 12 communicatively coupled to a light modulator 14 according to one embodiment of the present disclosure. In the example embodiment, a spinning color wheel 16 sequentially filters a light beam 18 in response to signals received from controller 12. The sequential filtration of light beam 18 produces colored light beams 15 that are directed to light modulator 14. Colored light beams 15, however, may be produced in any suitable manner. For example, light emitter diodes (LEDs), lasers, and/or one or more prisms may be used to produce colored light beams 15. In operation, light modulator 14 spatially modulates colored light beams 15 in response to signals received from controller 12, thereby producing an image that is projected by lens 20.

Controller 12 generally refers to any hardware, software, other logic, or any suitable combination of the preceding that is capable of interfacing with light modulator 14 through a bus 13. In the example embodiment, controller 12 is an application-specific integrated circuit (ASIC) and may be part of currently existing ASICs that are also capable of processing input signals. The input signals may include, for example, received spatial information corresponding to a photolithographic pattern, an image, or a video stream; however, any suitable input signal may be used. Controller 12 outputs control signals, which correspond to the processed input signals, to light modulator 14 via bus 13. The control signals at least partially control the modulation of light performed by light modulator 14.

Light modulator 14 generally refers to any device capable of spatially modulating light. For example, light modulator 14 may be a liquid crystal display (LCD), an interferometric modulator, or a liquid crystal on silicon (LCOS) display. In the illustrated embodiment, however, light modulator 14 is a DMD™ having an array of hundreds of thousands of deformable micromirrors. Electrostatic forces aid in transitioning each micromirror between "on" state and "off" state positions. The electrostatic forces are at least partially controlled by signals received from controller 12 via bus 13.

In some alternative embodiments, optical system 10 may include more than one light modulator 14. Accordingly, controller 12 may have a first mode of operation configured to interface with only one light modulator 14, and a second mode of operation configured to interface with a plurality of light modulators. A system having a controller configured to interface with multiple light modulators is described further below with reference to FIG. 2.

Figure 2:
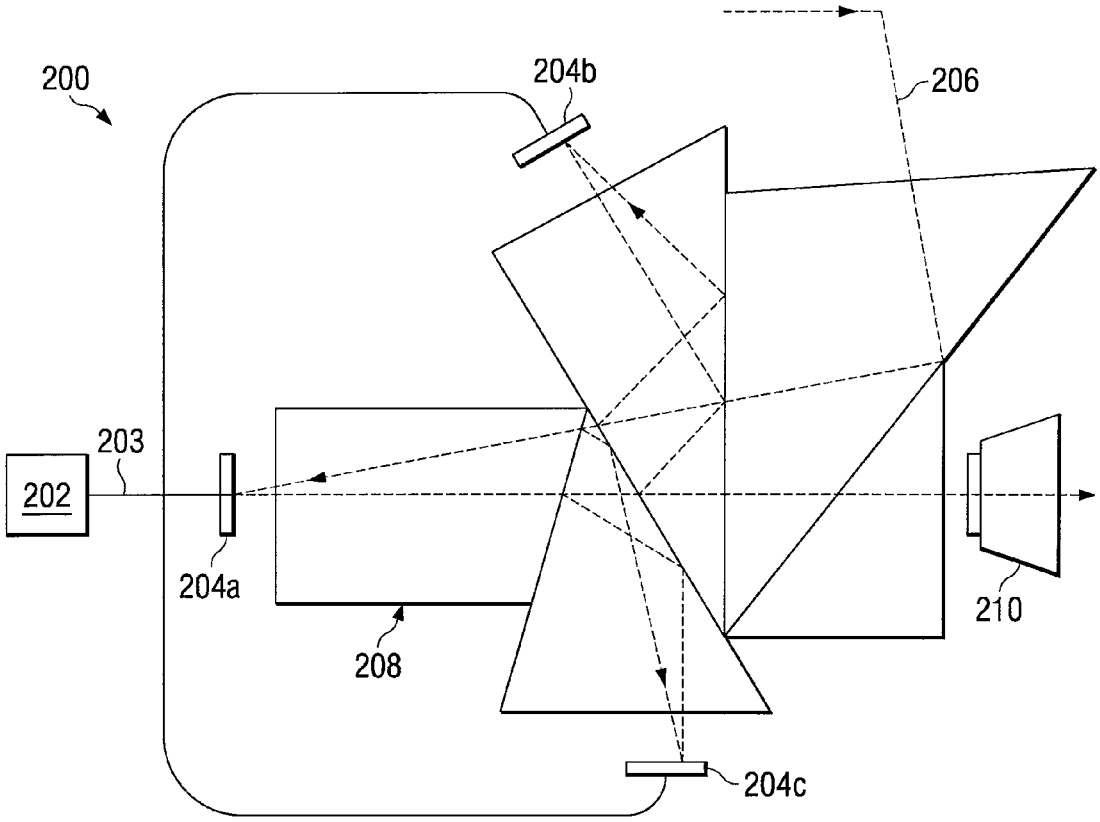
FIG. 2 is a block diagram of a portion of an optical system having a controller communicatively coupled to multiple light modulators according to one embodiment of the present disclosure.

FIG. 2 is a block diagram of a portion of an optical system 200 having a controller 202 communicatively coupled to multiple light modulators 204*a*, 204*b*, and 204*c* according to one embodiment of the present disclosure.

Controller 202 generally refers to any hardware, software, other logic, or any suitable combination of the preceding that is capable of interfacing in parallel with light modulators 204 through a bus 203. In the example embodiment, controller 202 is included in an application-specific integrated circuit (ASIC) that is further operable to process input signals. The input signals may include, for example, spatial information corresponding to a photolithographic pattern, an image, or a video stream; however, any suitable input signals may be used. Controller 12 outputs control signals corresponding to the processed input signals to light modulators 204 via bus 203. The control signals at least partially control the modulation of light performed by light modulators 204.

In the illustrated embodiment, optical system 200 is a 3-DMD™ projector. That is, each light modulator 204*a*, 204*b*, and 204*c* is a DMD™; however, any suitable light modulators 204*a*, 204*b*, and 204*c* may be used. An incoming light beam 206 can be split into multiple colors in a variety of ways. For example, a prism assembly 208 may be used to separate the red, green, and blue components to one of three separate light modulators (204*a*, 204*b*, and 204*c*). Prism assembly 208 recombines the modulated light received from light modulators 204 into a beam that is projected by lens 210.

A system such as this can exhibit extremely good color fidelity in its output. Because modulation speed of a digital micromirror is normally much faster than an equivalent LCD panel, a very high number of different colors can be produced at each pixel. In addition, the illustrated embodiment is very efficient in its use of light source illumination. In some video applications, more of a light source color can be used for each frame, thereby enhancing image brightness for a given lamp power.

For some applications, however, multiple-light-modulator systems may be superfluous. In addition, some conventional multiple-light-modulator systems are cost prohibitive for certain applications. For example, conventional 3-DMD™ projectors include a separate ASIC dedicated to each DMD™, and thus incur the cost of three separate ASIC chips. Accordingly, teachings of some embodiments of the present disclosure recognize a method and system for a configurable controller capable of interfacing with one or more light modulators. An example controller having this capability is illustrated in FIG. 3.

Figure 3:
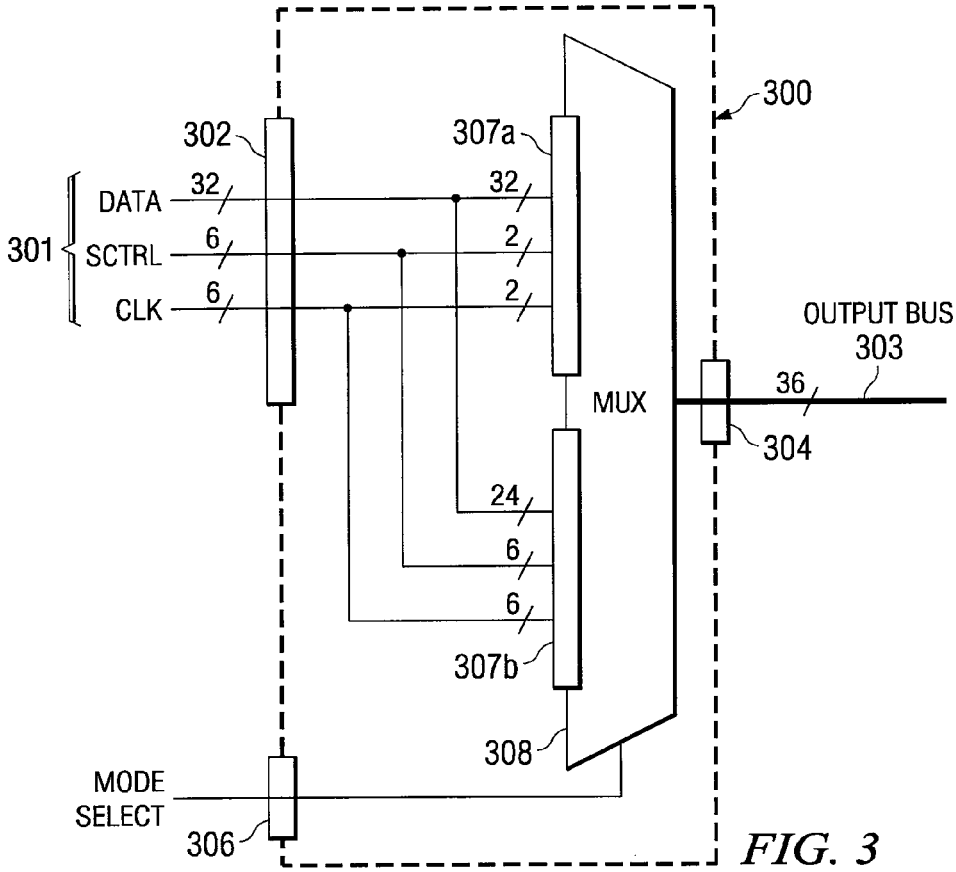
FIG. 3 is a schematic illustrating a portion of a configurable controller capable of interfacing with one or more of the light modulators of FIGS. 1 and 2.

FIG. 3 is one example schematic illustrating a portion of a configurable controller 300 capable of interfacing with one or more of the light modulators 14 and 204 of FIGS. 1 and 2 respectively. Controller 300 generally refers to any hardware, software, other logic, or any suitable combination of the preceding that is capable of interfacing with a single light modulator in a first mode, and with multiple light modulators in a second mode. In addition, controller 300 is capable of processing input signals received from input bus 301. The input signals may include, for example, spatial information corresponding to a photolithographic pattern, an image, or a video stream; however, any suitable input signals may be used.

In the example embodiment, controller 300 interfaces with input bus 301 through an input bus interface 302, and an output bus 303 through an output bus interface 304. Input bus interface 302 includes 32 data nodes, 6 control nodes, and 6 clock nodes; however, any suitable input bus interface may be used. Nodes as used herein generally refer to any interface element of a device capable of communicatively coupling the device to a bus. Examples of such nodes include externally-accessible nodes or conductive pads on a package. Output bus interface 304 includes 36 output nodes configured to communicate signals in a manner dependent on the operational mode of controller 300.

Figure 4:
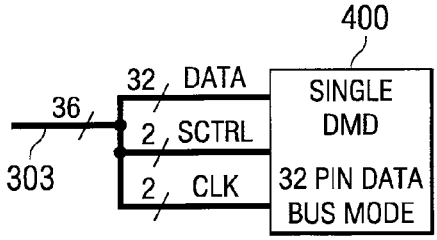
FIG. 4 is a schematic illustrating a single DMD™ coupled to a bus controlled by the configurable controller of FIG. 3 according to one embodiment of the present disclosure.
Figure 5:
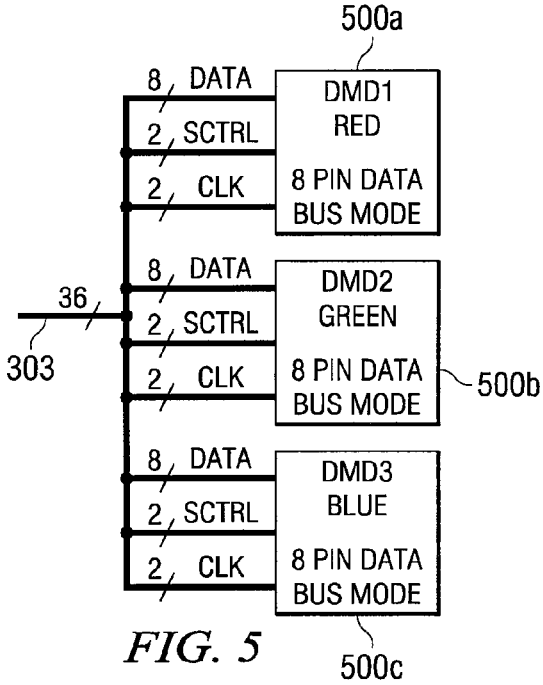
FIG. 5 is a schematic illustrating three DMD™s coupled in parallel to a bus that may be controlled by the configurable controller of FIG. 3 according to one embodiment of the present disclosure.

For example, in a first mode of operation, output bus interface 304 may be configured to have 32 data nodes, 2 control nodes and 2 clock nodes. In this manner, output bus interface 304 may control a 36-line bus 303 coupled to a single DMD™, as illustrated in FIG. 4. In a second mode of operation, output bus interface 304 may be configured to have 3*8 data nodes, 3*2 control nodes, and 3*2 clock nodes. In this manner, output bus interface 304 may control a 36-line bus 303 coupled in parallel to 3 DMDs™, as illustrated in FIG. 5. Although, in this example, the first and second modes of operation share the same output bus interface 304, some other embodiments may have separate output bus interfaces dedicated to respective modes of operation. For example, some alternative embodiments may include 36 output nodes dedicated to a first mode of operation, and another 36 output nodes dedicated to a second mode of operation.

In the example embodiment, however, a mode-select input 306 coupled to a multiplexer 308 configures controller 300 to switch between plural modes of operation in a manner that shares output bus interface 304. For embodiments using only two modes of operation, high or low voltage signals communicated to mode-select input 306 may switch controller 300 between first and second modes of operation. In an alternative embodiment, a signal communicated to mode-select input 306 may trigger an internal fuse that permanently fixes the operational mode of controller 306. Although FIG. 3 illustrates mode-select input 306 as having a single data line, any suitable number of lines may be used. For example, controller 300 may alternatively have four operational modes that are selected using two mode-select input lines coupled to respective nodes of controller 300.

In the example embodiment, circuitry within controller 300 couples input bus interface 302 to multiplexer 308 in parallel configurations. A first internal configuration 307*a* uses all 32 data lines of input bus interface 302 and only a subset of the control and clock lines. Configuration 307*a* corresponds to the first mode of operation described previously. A second internal configuration 307*b* uses a subset of the 32 data lines of input bus interface 302, and all the control and clock lines. Configuration 307*b* corresponds to the second mode of operation described previously. A signal received from mode-select input 306 determines which configuration 307*a* or 307*b* controls shared output bus interface 304. Some alternative embodiments may not include multiplexer 308. For example, some alternative embodiments may include separate or only partially shared output node sets dedicated to each of various modes of operation.

FIG. 4 is a schematic illustrating a single DMD™ 400 coupled to the 36-line bus 303 controlled by the configurable controller 300 of FIG. 3 according to one embodiment of the present disclosure. In some embodiments, DMD™ 400 may be used as light modulator 14 of optical system 10. In this example, DMD™ 400 is configured to receive a 32-line data bus, thereby increasing operational efficiency of DMD™ 400 over configurations using a data bus with fewer bus lines. This example uses a point-to-point communicative interface between controller 300 and DMD™ 400. That is, in the example configuration, each output interface node of controller 300 is communicatively coupled to only one input interface node of DMD™ 400. Such a configuration may minimize signal integrity issues and generally enhance communicative coupling.

FIG. 5 is a schematic illustrating three DMD™s 500*a*, 500*b*, and 500*c*, coupled in parallel to the 36-line bus 303 controlled by the configurable controller of FIG. 3 according to one embodiment of the present disclosure. In some embodiments, DMDs™ 500*a*, 500*b*, and 500*c* may be used as light modulators 204*a*, 204*b*, and 204*c* respectively of optical system 200. In this example, each DMD™ 500 is configured to receive an 8-line data bus. Although each DMD™ 500 loads information four times slower than the configuration of DMD™ 400 of FIG. 4, the three data bus inputs may run in parallel and thus all DMDs™ 500 may load at the same time. This system of FIG. 5 is another example of a point-to-point communicative interface.

Thus, in some embodiments, the teachings of the present disclosure provide a configurable bus controller that may be used as a drop-in, cost-effective, and reliable ASIC to either single DMD™ and/or multiple-DMD™ display systems.

Although the present disclosure has been described with several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. A display system comprising:

a plurality of deformable micromirror devices communicatively coupled to a bus; and a bus controller communicatively coupled through the bus to each of the plurality of deformable micromirror devices, the bus controller comprising:

a configurable bus interface having first and second modes of operation, the first mode of operation configured to interface with only one of the plurality of deformable micromirror devices, the second mode of operation configured to interface in parallel with each of the plurality of deformable micromirror devices;

a multiplexer operable to switch the configurable bus interface between the first and second modes of operation;

a first and a second set of input lines coupled to the multiplexer, the first set and second sets corresponding respectively to the first and second modes of operation; and wherein each input line of at least a subset of the first set of input lines is communicatively coupled to a respective input line of the second set of inputs lines.

2. The display system of claim 1, wherein the bus controller is an application-specific integrated circuit.

3. The display system of claim 1, wherein:

the configurable bus interface has a predetermined number of bus lines; and each bus line couples respectively to at most one input node of only one of the plurality of deformable micromirror devices.

4. The display system of claim 1, further comprising optics operable to provide a colored light beam to the plurality of deformable micromirror devices.

5. The display system of claim 4, wherein the optics comprises an element selected from the group consisting of:

a light source operable to provide a colored beam of light;

a color wheel; and a prism.

6. A bus controller comprising:

an interface operable to communicate with a plurality of spatial light modulators; and a multiplexer operable to:

configure the interface to a first mode of operation wherein the interface may communicate with only one of the plurality of spatial light modulators; and configure the interface to a second mode of operation wherein the interface may simultaneously communicate with a plurality of spatial light modulators.

7. The bus controller of claim 6, wherein the bus controller is an application-specific integrated circuit.

8. The bus controller of claim 6, wherein the one or more spatial light modulators are deformable micromirror devices.

9. The bus controller of claim 6 further comprising circuitry operable to permanently select between the first and select modes of operation in response to an input.

10. The bus controller of claim 6, wherein:

the interface has a predetermined number of bus lines; and each bus line couples respectively to at most one input node of one of the one or more spatial light modulators.

11. The bus controller of claim 6, wherein the interface has a first and a second set of output nodes corresponding respectively to the first and second modes of operation.

12. The bus controller of claim 11, wherein the first and second sets of output nodes comprise the same number of nodes.

13. A bus controller comprising:

an interface operable to communicate with a plurality of spatial light modulators; and a multiplexer operable to:

configure the interface to a first mode of operation wherein the interface may communicate with only one of the plurality of spatial light modulators;

configure the interface to a second mode of operation wherein the interface may communicate with a plurality of spatial light modulators, wherein the multiplexer is operable to switch between the first and second modes of operation.

14. A method of controlling a bus comprising:

providing a bus controller operable to communicate across M signal lines in at least two modes, the modes comprising:

a mode in which the M signal lines comprise N data lines and P control and clock lines to communicate an N-bit word to a destination;

a mode in which the M signal lines comprise Q sets of channels, each channel comprising R separate data lines and additional control and clock lines to simultaneously communicate Q R-bit words to Q destinations, wherein Q*R is less than or equal to N; and configuring a bus interface of a bus controller to interface in parallel with a plurality of deformable micromirror devices.

15. The method of claim 14, wherein configuring a bus interface of a bus controller comprises configuring a bus interface of a bus controller that is an application-specific integrated circuit.

16. The method of claim 14, wherein each deformable micromirror device of the plurality of deformable micromirror devices is a digital micromirror device.

17. The method of claim 14 further comprising:

configuring each of a plurality of bus lines of the bus interface to interface with one and only one input of one of the plurality of deformable micromirror devices.

18. The method of claim 14 further comprising configuring the bus interface of the bus controller to interface with only one of the plurality of deformable micromirror devices in response to a signal.

19. The method of claim 18 further comprising:

receiving the signal by a multiplexer coupled to the bus controller; and selecting, by the multiplexer in response to the signal, a particular configuration of the bus interface from among multiple configurations.

20. The method of claim 18 further comprising:

receiving the signal by circuitry coupled to the bus controller; and selecting, by the circuitry in response to the signal, a permanent mode of operation from among plural modes of operation.

* * * * *